US011639628B2

(12) United States Patent
Vianello et al.

(10) Patent No.: US 11,639,628 B2
(45) Date of Patent: May 2, 2023

(54) AUTOMATIC MACHINE AND AUTOMATIC METHOD FOR SEALING THE PERIMETRIC EDGE OF THE INSULATING GLAZING UNIT HAVING IRREGULAR GEOMETRY

(71) Applicant: FOREL SPA, Roncade (IT)

(72) Inventors: Fortunato Vianello, Roncade (IT); Riccardo Vianello, Roncade (IT)

(73) Assignee: FOREL SPA, Roncade (IT)

( * ) Notice: Subject to any disclaimer, the term of this patent is extended or adjusted under 35 U.S.C. 154(b) by 325 days.

(21) Appl. No.: 16/644,925

(22) PCT Filed: Aug. 24, 2018

(86) PCT No.: PCT/EP2018/072908
§ 371 (c)(1),
(2) Date: Mar. 5, 2020

(87) PCT Pub. No.: WO2019/048268
PCT Pub. Date: Mar. 14, 2019

(65) Prior Publication Data

US 2021/0071468 A1 Mar. 11, 2021

(30) Foreign Application Priority Data

Sep. 11, 2017 (IT) ..... 102017000101114

(51) Int. Cl.
*E06B 3/67* (2006.01)
*E06B 3/66* (2006.01)
*E06B 3/673* (2006.01)

(52) U.S. Cl.
CPC ..... *E06B 3/67343* (2013.01); *E06B 3/6617* (2013.01); *E06B 3/67391* (2013.01)

(58) Field of Classification Search
CPC ..... E06B 3/6617; E06B 3/67343; E06B 3/67347; E06B 3/67391; E06B 2003/67378; E06B 2003/67395
See application file for complete search history.

(56) References Cited

U.S. PATENT DOCUMENTS 4,617,073 A * 10/1986 Scott ..... E06B 3/67343 269/254 R
5,888,341 A * 3/1999 Lafond ..... E06B 3/6733 156/107

(Continued)

FOREIGN PATENT DOCUMENTS

| | | |
|---|---|---|
| AT | 403912 B | 11/1993 |
| DE | 3217410 A1 | 11/1983 |
| GB | 2016960 A | 9/1979 |

OTHER PUBLICATIONS

Machine Translation of DE3217410A1; https://worldwide.espacenet.com/patent/search/family/006163123/publication/DE3217410A1?q=DE3217410 (Year: 2022).*

(Continued)

*Primary Examiner* — Ryan D Kwiecinski
(74) *Attorney, Agent, or Firm* — Thomas | Horstemeyer, LLP

(57) ABSTRACT

A machine (1000) for the automatic sealing of the perimetric cavity of the insulating glazing unit (1, 1', 1", 1'''), the geometry of which is irregular in terms of flatness and shape with respect to the theoretical one, constituted by at least two glass panes (2, 2', 2", 2''', etc.) having a rectangular or other than rectangular shape and at least one spacer frame (3, 3', 3", etc., 5, 5', 5", etc.) located proximate to the perimeter at a finite distance from the margin of the glass panes or of the smaller glass pane, the glass panes being optionally aligned or offset along one or more or all the perimetric sides and the (Continued)

thickness both of each glass pane (2, 2', 2'', 2'', etc.) and of each spacer frame (3, 3', 3'', etc., 5, 5', 5'', etc.) and therefore the total thickness of the insulating glazing unit (1) being variable from one insulating glazing unit to another, constituted by: at least one synchronous conveyor (100) having the function of support and displacement [together with the synchronous suction cup carriage (100')] of the insulating glazing unit (1) along the horizontal axis H during the sealing cycle; at least one synchronous carriage (200) which runs along vertical guides along the vertical axis V and is provided with the sealing head (300), the head having a synchronous rotary motion θ so that the sealing nozzle (301) is oriented so as to be tangent to the perimeter of the insulating glazing unit (1), or in any case the relative movement between the insulating glazing unit (1) and the sealing nozzle (301) being able to occur by means of different mechanisms and the arrangement of the insulating glazing unit (1) being any, and fed by one or more, in case of a plurality of types of sealants, synchronous volumetric units for the dosage of bi-component (400) or mono-component (450) sealant, each assembly being constituted, for the two-component case, by a dosage unit for the base product and by a dosage unit for the catalyst product, the flow rates of which are adjusted: as a function of the stoichiometric dosage ratio, for the bi-component case, and of the dimensions of the cavity of the perimetric edge comprised between the glass panes (2, 2', 2'', 2''', etc.) and the outside curve of the spacer frame (3, 3', 3'', etc., 5, 5', 5'', etc.) and of the relative speed between the nozzle (301) and the perimeter of the insulating glazing unit (1), so as to fill the cavity up to the extreme margin of the smaller glass pane or of the glass panes if aligned, wherein the devices (304, 501, 502) interfaced and operating in connection with the perimetric cavity of the insulating glazing unit (1) during the corresponding sealing follow without discontinuity the actual position of the cavity along the transverse axis Z, which is different from the theoretical one due to non-flatness of the insulating glazing unit (1).

11 Claims, 13 Drawing Sheets

(56) References Cited

U.S. PATENT DOCUMENTS

| | | | | |
|---|---|---|---|---|
| 5,932,062 | A * | 8/1999 | Manser | B05C 5/0216 156/107 |
| 7,094,128 | B2 * | 8/2006 | Vianello | B24B 9/102 451/8 |
| 7,357,169 | B2 * | 4/2008 | Vianello | E06B 3/6733 156/566 |
| 7,922,842 | B2 * | 4/2011 | Vianello | E06B 3/67343 156/107 |
| 8,522,831 | B2 * | 9/2013 | Vianello | E06B 3/6775 141/4 |
| 9,656,356 | B2 * | 5/2017 | Pemberton | E06B 3/67304 |
| 10,702,966 | B2 * | 7/2020 | Vianello | B24B 27/0069 |
| 10,890,026 | B2 * | 1/2021 | Vianello | E06B 3/6733 |
| 11,248,414 | B2 * | 2/2022 | Vianello | E06B 3/66309 |
| 2009/0205768 | A1 | 8/2009 | Vianello | |
| 2020/0047304 | A1 * | 2/2020 | Vianello | B24B 27/0023 |
| 2020/0141179 | A1 * | 5/2020 | Vianello | E06B 3/6617 |
| 2021/0071468 | A1 * | 3/2021 | Vianello | E06B 3/6617 |
| 2021/0140229 | A1 * | 5/2021 | Moschini | E06B 3/67386 |
| 2021/0254398 | A1 * | 8/2021 | Andersen | E06B 3/6612 |
| 2021/0332637 | A1 * | 10/2021 | Vianello | E06B 3/6617 |

OTHER PUBLICATIONS

International Search Report for PCT/EP2018/072908 dated Nov. 15, 2018.

* cited by examiner 1
2
2'
7
3
4
2"
3'
2M
2'm
6
8
6'
5
2"m
5'

AUTOMATIC MACHINE AND AUTOMATIC METHOD FOR SEALING THE PERIMETRIC EDGE OF THE INSULATING GLAZING UNIT HAVING IRREGULAR GEOMETRY

CROSS-REFERENCE TO RELATED APPLICATIONS

This application is the 35 U.S.C. § 371 national stage application of PCT Application No. PCT/EP2018/072908, filed Aug. 24, 2018, where the PCT claims priority to, and the benefit of, Italian application no. 102017000101114, filed Sep. 11, 2017, both of which are herein incorporated by reference in their entireties.

FIELD OF APPLICATION

The field of application is the one according to the preamble of claim 1.

BACKGROUND ART AND RELATED PROBLEMS

Currently it is known to deposit the rigid spacer frame 3 or the flexible spacer profile 5, pre-spread with sealant 6 and/or adhesive 6', on a glass pane 2 to then mate the assembly with a second glass pane 2' and seal it along the entire cavity of the external peripheral region so as to constitute the so-called insulating glazing unit 1. The operation can also be multiple in order to obtain the insulating glazing unit 1 constituted by three glass panes 2, 2', 2" and two frames 3, 3' or spacer profiles 5, 5', as well as n glass panes 2, 2', 2", 2'", etc. and n−1 frames 3, 3', 3", etc. or spacer profiles 5, 5', 5", etc.

These glass panes 2, 2', etc., being derived from upstream treatment processes, which despite being accurate are however not free from imperfections, can have geometries that are not regular as regards the dimensions and shape and especially flatness.

It is indeed in these situations, although not only for these situations, that the solutions of the invention according to the present application are essentially important, since the background art seals the mentioned cavity by working correctly only in the case of regular geometries.

In particular, since non-flatness is meticulously classified by appropriate standards, for example the American standards ASTM C 1036-11 for flat glass panes, ASTM C 1048-12 for tempered glass panes, ASTM C 1172-14 for laminated glass panes, said non-flatness must constitute a data entry toward the machinery and said machinery must be provided with contrivances that render these defects irrelevant since they are solved by means of predominantly mechatronic devices.

Thus, irrelevance of the inaccurate geometry of the glass panes with respect to the process for sealing the perimetric cavity can only be achieved by following the irregularities of the glass panes, especially since the user who purchases the machinery reasonably expects that it can, and must, process the glass panes as they are available on the market and since the manufacture of the glass panes cannot be the subject of a complaint if the flatness errors fall within the rather permissive standards, for example the listed ones or other similar ones.

Assuming that the subsequent use of the insulating glazing unit 1, i.e., in the door or window or in continuous faces or in structural faces, is known, in detail the insulating glazing unit 1 is constituted by the composition of two or more glass panes 2, 2', 2", 2'", etc., separated by one or more spacer frames 3, 3', 3", etc., generally made of inorganic material such as aluminum or stainless steel or mixed inorganic/organic material, the latter being generally PVC (polyvinyl chloride, but not only), which are generally hollow and microperforated on the face that is directed inward, the spacer frames containing, in their hollow part, hygroscopic material 4 and being provided with a butyl sealant 6 on the lateral faces (constituting the so-called first seal), or by spacer profiles 5, 5', 5", etc. and the chamber (or chambers) delimited by the glass panes 2, 2', 2", 2'", etc. and by the spacer frame (frames) 3, 3', 3", etc., 5, 5', 5", etc., being able to contain air or gas 8 or mixtures of gases 8 which give the insulating glazing unit particular properties, for example thermally insulating and/or soundproofing properties. Recently the use of the spacer profile 5 having an essentially rectangular cross-section, optionally containing two receptacles on its sides designed for the butyl sealant 6, made of expanded synthetic organic material (by way of non-exhaustive indication: silicone and EPM) which embeds in its mass the hygroscopic material 4 and is provided on its sides or part thereof with an adhesive 6' useful for mechanical bonding with the glass panes, has also become widespread.

The joining between the glass panes 2, 2', 2", 2'" etc. and the spacer frame (frames) 3, 3', 3", etc. or spacer profile (profiles) converted into a frame (frames) 5, 5', 5", etc. is obtained by means of two levels of sealing, the first one (also known in the jargon as primary) 6 having the function of providing a hermetic seal and an initial bonding between these components and affecting the lateral surfaces of the frame and the portions of the adjacent glass panes, which has already been mentioned earlier (butyl, thermoplastic sealant), the second one (also known in the jargon as secondary) 7, typically constituted by a bi-component elastomeric sealant, such as polysulfide (PS) or polyurethane (PU) or silicone (SI), processed at ambient temperature, but also constituted by single-component sealant of the type processed at ambient temperature or of the hot-processed type, which has the function of providing the final cohesion between the components and the mechanical strength of the joint between them and affecting the compartment constituted by the outer curved surface of the spacer frame 3, 3', 3", etc., 5, 5', 5", etc. and by the internal faces of the glass panes up to their edge (see FIG. 1).

In the case of a spacer profile 5 made of expanded synthetic material, the first level of sealing is replaced (in this case losing the hermetic sealing function) or can be integrated (in this case preserving the hermetic sealing function) by an adhesive 6', for example an acrylic one, already spread on the lateral faces of the spacer profile, and covered by a removable protective film (see FIGS. 1D and 1F, in which the film is already removed).

The glass panes 2, 2', 2", 2'" etc. used in the composition of the insulating glazing unit 1 can have different shapes as a function of its use, for example the external glass pane (external understood with respect to the building) can be normal or reflective or selective (in order to limit the heat input during summer months) or layered (also known as laminated, constituted by two or more glass panes which are intimately connected by one or more membranes made of PVB=polyvinyl butyral) or armored (for intrusion prevention/vandalism prevention/bulletproofing functions) or laminated and tempered (for safety functions) or combined (for example reflective and laminated in order to obtain a combination of properties); the internal glass pane (internal understood with respect to the building) can be normal or with low emissivity (in order to limit the dispersion of heat during winter months) or laminated and tempered (for safety functions) or combined (for example low-emissivity and laminated in order to obtain a combination of properties). In particular, the situations of glass panes which are layered, tempered and layered+tempered are the ones that are most affected by the defect of non-flatness.

From the simple summary presented it is already evident that a manufacturing line, in order to obtain the insulating glazing unit product 1, requires many processes in sequence and in particular comprises the process of second sealing, to which the present application relates with improving and innovative interventions.

The processes for the production of the insulating glazing unit 1, each requiring a corresponding and particular machine to be arranged in series with respect to the other complementary ones, are, by way of non-exhaustive example and at the same time not all necessary, the following: EDGING on the peripheral face of the glass pane in order to remove any coatings in order to allow and maintain over time the bonding of the primary sealant 6 and of the secondary sealant 7; BEVELING of the sharp edges of the glass pane, both to eliminate the margin defects introduced with the cutting operation, which potentially may trigger cracks, and to reduce the risks of injury in the subsequent handling both of the glass panes 2, 2', 2", 2'", etc. and of the finished insulating glazing unit 1; WASHING of the individual glass panes, with alternation of internal glass pane/any intermediate glass panes/external glass pane (the orientation being the one defined earlier); APPLICATION OF THE SPACER FRAME: the spacer frame 3, 3', 3", etc., filled with hygroscopic material 4 and spread on its lateral faces with a thermoplastic (butyl) sealant 6, which has sealing functions against the entry of humidity and the escape of the gas 8, manufactured beforehand in machines which are external with respect to the production line of the insulating glazing unit 1, is applied to one of the glass panes that constitute the insulating glazing unit 1 in an adapted station of the production line of the insulating glazing unit 1; as an alternative, a continuous strip of spacer profile 5, 5', 5", etc. is unwound from a spool and is applied to one of the glass panes until it also forms a closed frame, which is manufactured directly in adhesion against one of the glass panes, after removing the protective film, on the same production line of the insulating glazing unit 1; FILLING WITH GAS of the chamber (chambers) thus obtained and immediately subsequent MATING AND PRESSING of the glass panes/frame (frames) assembly;

SECOND SEALING of the assembly of components: glass panes 2, 2', 2", 2'", etc., spacer frame 3, 3', 3", etc., 5, 5', 5", etc., at the perimeter. The invention according to the present application relates in particular to new and innovative components in order to allow the operation of the machine that performs said process in the conditions in which the insulating glazing unit 1 as assembled prior to sealing is not sufficiently planar (first type of irregularity) and/or its peripheral geometry is not exactly (second type of irregularity) the one of the data entry that derives either from the management system or from readings performed only in a spot manner, i.e., not along the entire perimeter.

The search for patent prior art, filed in the same sector and describing machines and methods for the execution of the second sealing, leads to a very large number of inventions which relate to the solutions for the dosage and feeding of the secondary sealant 7 to the head and thus to the extrusion nozzle, in which the sealing product is distributed proximate to the outer curved surface of the rigid spacer frame (frames) 3, 3', 3" etc. or of the flexible spacer profile (profiles) 5, 5', 5" etc. in order to join it (them) mechanically to the glass panes 2, 2', 2", 2'", etc., and up to alignment with the edges of the glass panes or with the edge of the smallest glass pane **2'*m*, 2"*m* (in the case of insulating glazing units with glass panes 2M, 2'*m*, 2"*m* which are offset, as in FIGS. 1C, 1E, 1F) and sometimes (the case of FIG. 1E) with sealant product that is distributed (in the jargon spatulated) also against the face of the larger glass pane 2M for the part that protrudes with respect to the smaller glass pane (panes) 2'*m*, 2"*m* and constitute a sealing barrier with respect to humidity, which not must not penetrate inside the insulating glazing unit 1 and with respect to the filling gas 8, which must not escape toward the outside of the insulating glazing unit 1**.

These inventions, being widespread and therefore common and known since 1980, are neither listed nor commented, but only presented in FIGS. 5*a*, 5*b*, 6*a*, 6*b* and 7 for the part that relates to the path of the sealing products or product toward the perimetric joint of the insulating glazing unit 1, since this is a process that is useful also as a preamble of the present invention. Rather, it is pointed out that nearly all of this art has never indicated solutions to ensure that the perimetric joint is always followed by the extrusion nozzle or nozzles (the case of an insulating glazing unit constituted by more than two glass panes) even in case of non-flatness of the insulating glazing unit. At the most, the background art has presented solutions, albeit improper ones, for balancing the extrusion nozzle toward the irregularity of the perimeter of the insulating glazing unit, but assuming that its flatness is regular.

The only invention that provides suggestions for solution with respect to the first type of irregularity (non-flat insulating glazing unit) is U.S. Pat. No. 7,922,842 B2, with Italian priority TV2008A000032 dated 20 Feb. 2008, in the name of this same Applicant as the present application.

An invention that provides suggestions for solution with respect to the second type of irregularity (perimeter of the insulating glazing unit that does not correspond to data entry) is AT 4030912 B dated to 10 Nov. 1993, in the name of Lisec Peter.

These background art documents of the second type have the following drawbacks.

The first one describes a sensor the feedback of which acts on the synchronous transverse axis Z for the positioning of the nozzle or nozzles in order to arrange it (them) in the centerline of the cavity (cavities) of the perimetric joint; however, the adjustment might become unstable due to a drift effect, causing the tipping of the insulating glazing unit toward the work regions, particularly if of limited height.

The second one does not anticipate, in terms of function or in terms of means, which are in any case complex and therefore expensive, and achieves a precarious result, with respect to the content of the present application.

The aim of the present invention is to provide a device and a method that allow, always within the concept of performing the perimetric sealing of the joint of the insulating glazing unit 1:

following of the irregularity in the flatness of the insulating glazing unit; following the mismatch between theoretical position and actual position of the perimeter of the insulating glazing unit and therefore of its peripheral joint;

safety in the process from the point of view of accident prevention; superior qualitative results with respect to those of the background art.

Within this aim, an object of the present invention is to provide a device and a method that allow to overcome the drawbacks of the prior art.

DESCRIPTION OF THE INVENTION

The summary description of the drawings and the detailed description of a way of carrying out the invention will clarify how the invention according to the present application can be embodied.

DESCRIPTION OF THE FIGURES

FIG. 1 is a schematic view of the peripheral portion of the insulating glazing unit 1 in a non-exhaustive exemplifying series of possible combinations: 1A normal; 1B triple glazing unit with internal glass pane with low-emissivity coating; 1C external glass pane with selective coating and offset with respect to the internal glass pane with low-emissivity coating; 1D tempered external glass pane, internal glass pane with low-emissivity coating; 1E layered external glass pane, offset with respect to the internal glass pane with low-emissivity coating; 1F layered external glass pane offset with respect to the remaining two glass panes, of which the internal one has a low-emissivity coating. FIGS. 1A, 1B, 1C and 1E show the rigid frame 3 made of metallic profile (typically aluminum or stainless steel or a combination of stainless steel/plastic), which is hollow and filled with hygroscopic material 4, while FIGS. 1D and 1F show the frame of the flexible type 5, which embeds in its mass the hygroscopic material 4, but for the purposes of the description the solution indicated for the frame is irrelevant. The two types of sealant used are highlighted in cross-section: in black, the butyl sealant 6, which has the function of initial bond between the components and of seal (first seal and primary sealant), in the case of a flexible frame 5 it is replaced with an acrylic adhesive 6' (shown emphasized, since it has an actual thickness of a few μm) or the combination of the acrylic sealant 6' and of the butyl sealant 6 applied between the receptacles of the lateral surfaces of the frame and the glass panes, as visible in FIGS. 1D and 1F, is used; in dashed lines, the polysulfide (PS) or polyurethane (PU) or silicone (SRI) sealant 7, which has the function of a mechanical coupling to the edge and of a seal (second seal and secondary sealant) applied between the outer curved surface of the frame and the faces of the glass panes up to the edge of the glass panes or pane 2'*m* that has the smallest dimensions (in the case of offset glass panes). The secondary sealant 7 also provides a contribution, albeit a smaller one than the primary sealant 6, to the seal against the entry of humidity and the escape of the gas 8. FIGS. 1D, 1E, 1F show the cases for which the present invention has an essential relevance, i.e., the cases of large dimensions of the insulating glazing units (both in terms of sides of the glass panes and of thickness thereof, the panes being of the tempered and/or laminated type) such as for example architectural work such as the one required in Apple stores, which reach dimensions of 12 m×3.3 m. And it is indeed for these cases and in any case in general that the present invention has an essential relevance, the glass panes of these types, due to their extensions, entailing flatness errors that are absolutely far greater than the accepted tolerance in misalignment between the extrusion nozzle and other devices of the sealing head toward the centerline of the cavity to be sealed.

FIG. 1E indicates a situation for which, all the more, the placement of the extrusion nozzle must be matched with the face of the larger glass pane 2M since the nozzle, in addition to filling the perimetric cavity of the insulating glazing unit 1, must spread the sealant 7 also and simultaneously against the face of the glass pane 2M that protrudes with respect to the glass pane 2'*m*, i.e., the lateral gap for the supply of the sealant which is located in the same nozzle must remain mated with the face of the glass pane 2M, which due to what has been described above is not certainly flat.

The internal/external orientation is visually identified with icons that represent the sun (outer side) and the radiator (inner side). In all the figures, the secondary sealant 7 is referenced in the condition of filling the perimetric joint, since its extrusion is the main subject matter of the present invention.

From these figures one deduces that the insulating glazing unit 1 can have multiple shapes and that the machines for the application of the second seal must be both special and versatile, for example to seal the insulating glazing unit 1 composed of two glass panes, the one composed of three glass panes, the one with offset glass panes, and the one composed of three or more than three glass panes, of which one or more, larger and therefore offset with respect to the remaining ones, characteristics of machines that are already established in the background art, and these machines must work by mating with the actual position of the perimetric joint, which does not correspond to the ideally precise theoretical position, which does not occur or occurs partially in the machines according to the background art.

Figures 1, 1A, 1B, 1C, 1D, 1E, 1F:
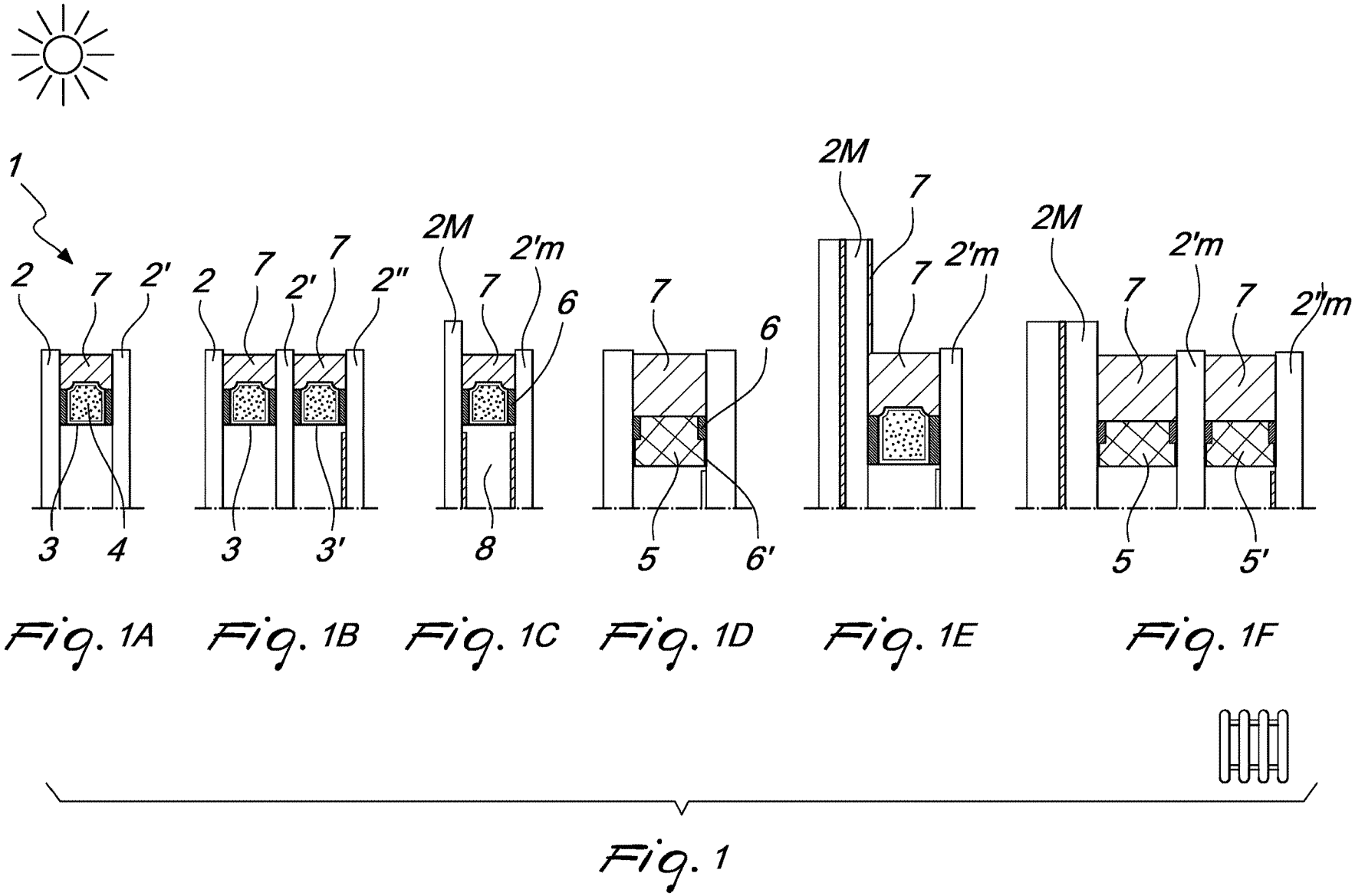
Figure 2:
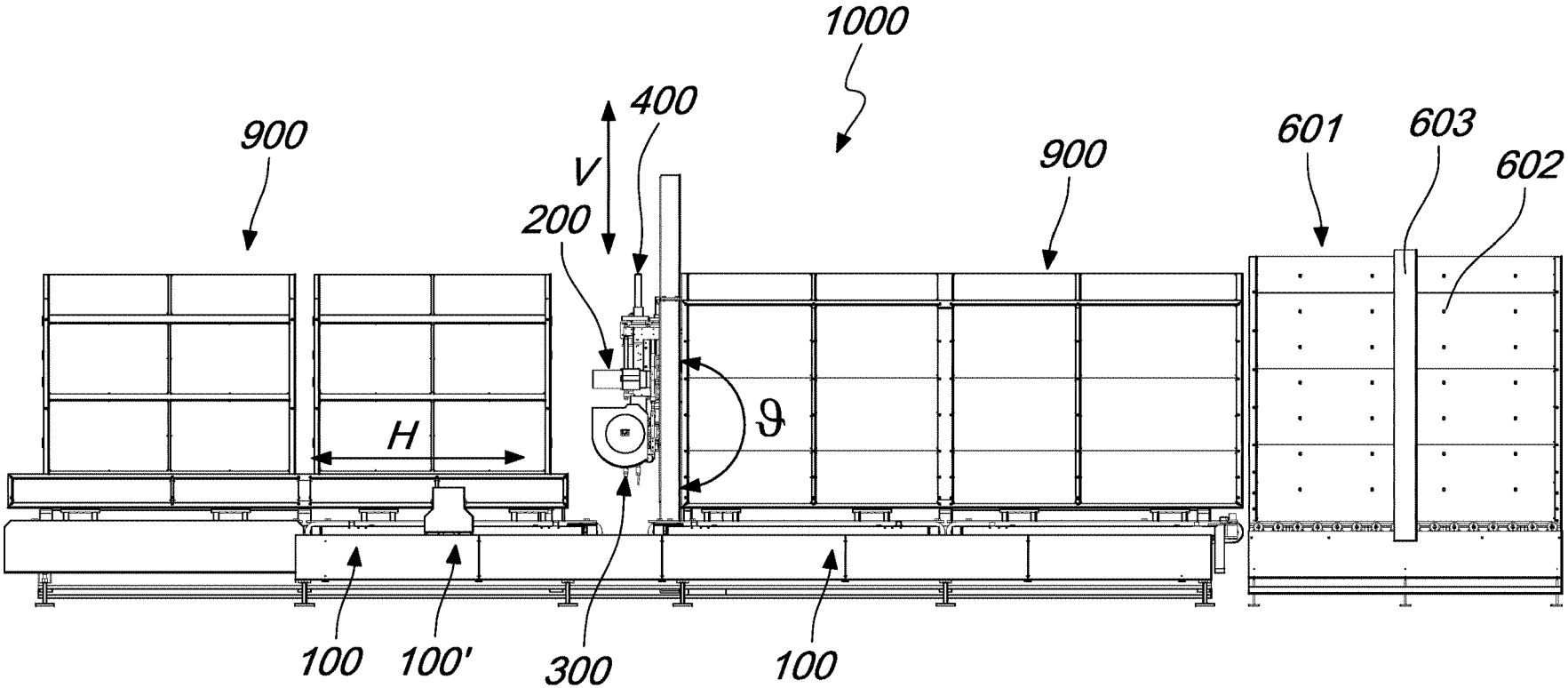
Figure 3:
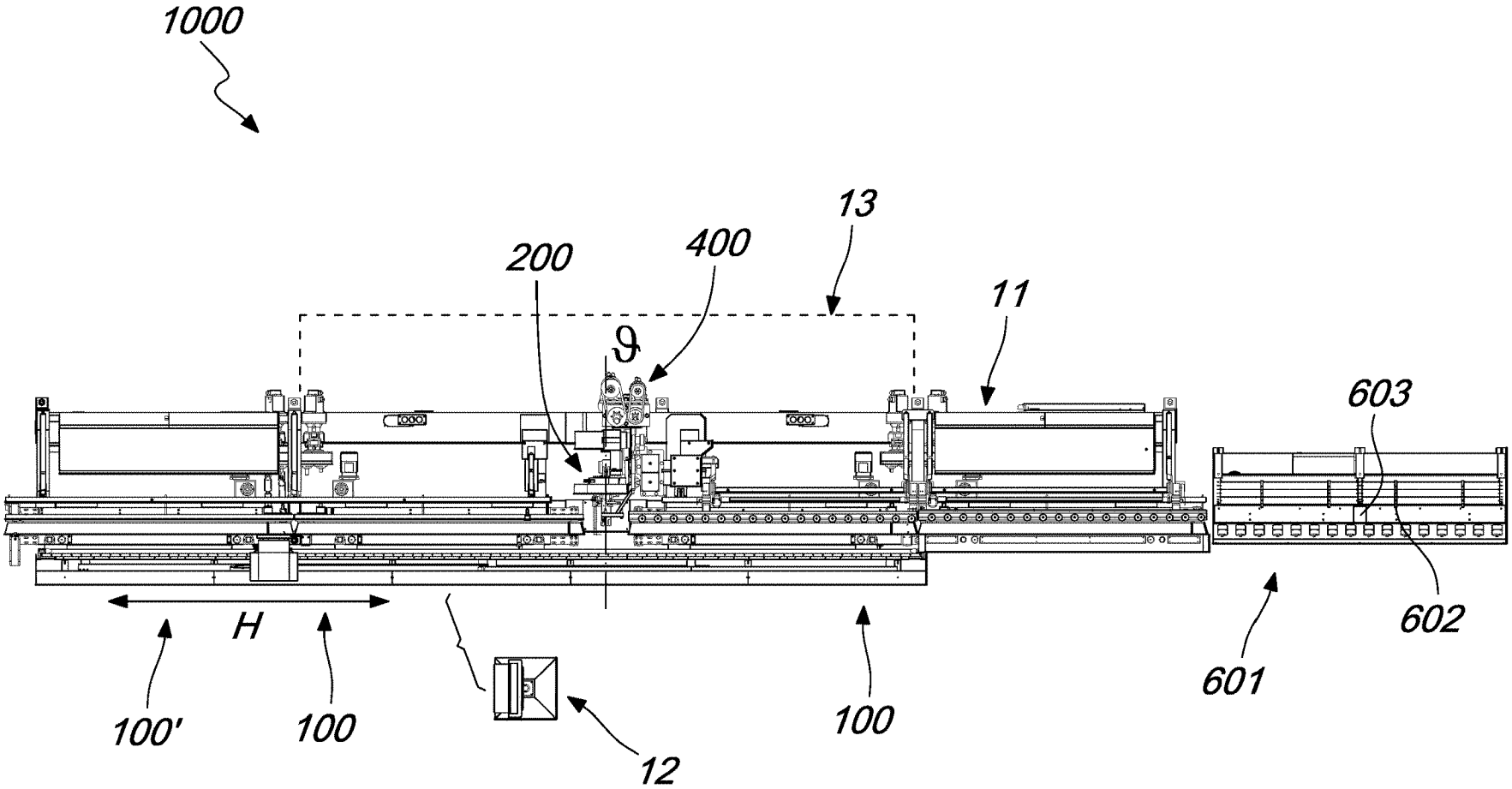
Figure 4:
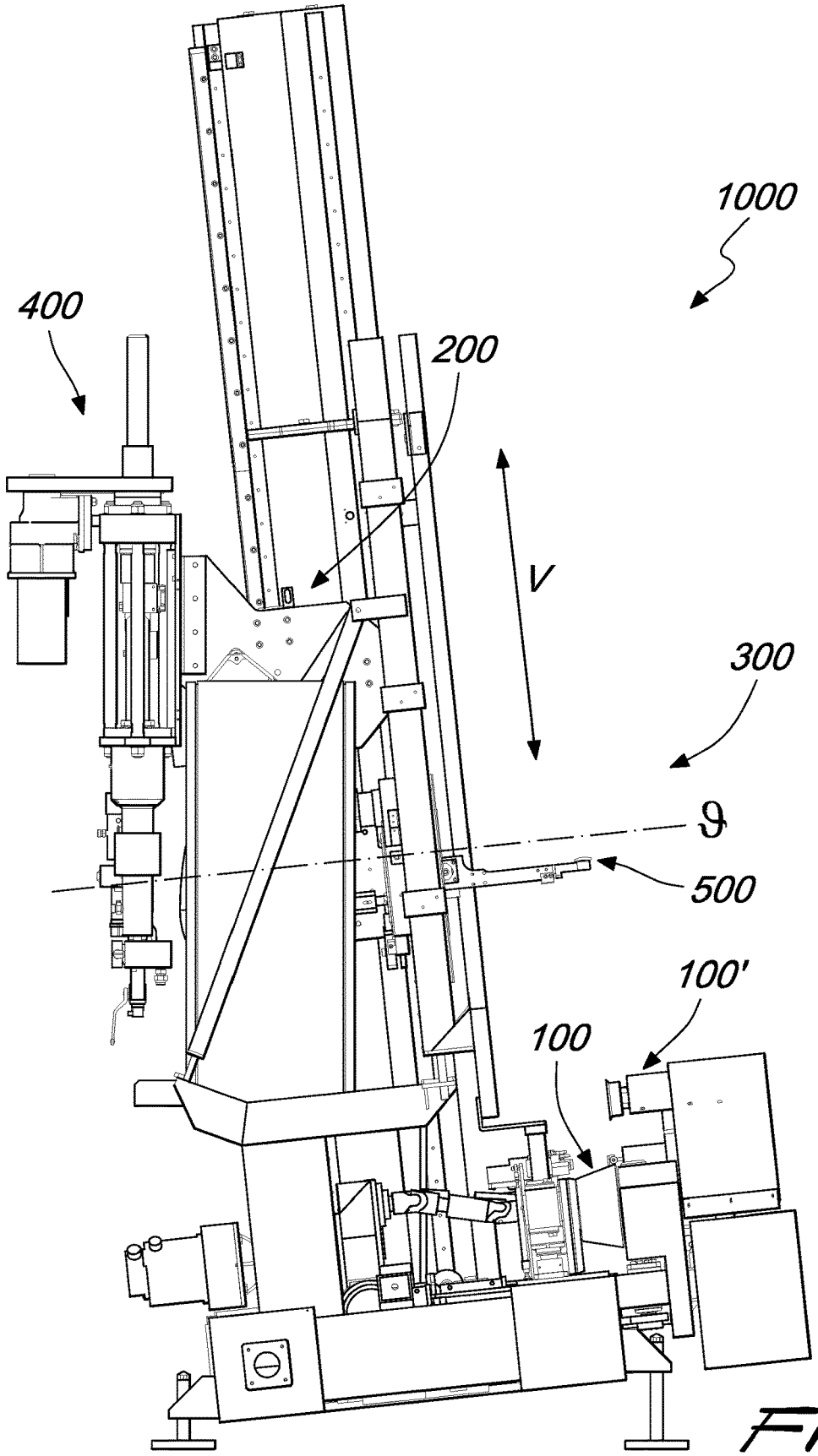

FIGS. 2, 3, 4 are views of the complete machine (automatic sealing machine according to the background art), which includes the subject matter of the present invention, respectively in its general main views: front, from above, from the side, with identification of the horizontal axis H [actuated by the means assembly 100 of the known type, constituted both by the motorized pseudo-horizontal conveyors that act on the lower edge 1*d* of the insulating glazing unit 1 and by the suction cup carriage 100' which acts on the face of the insulating glazing unit 1, while the insulating glazing unit 1 remains resting on the motorized pseudo-horizontal conveyors, which are slightly inclined with respect to the horizontal plane, and on a pseudo-vertical sliding plane 900, which is slightly inclined with respect to the vertical plane and is provided with free wheels or with an air cushion], of the vertical axis V (assembly 200 of the known type) and of the rotation axis θ (assembly 300 of the known type).

Figure 5A:
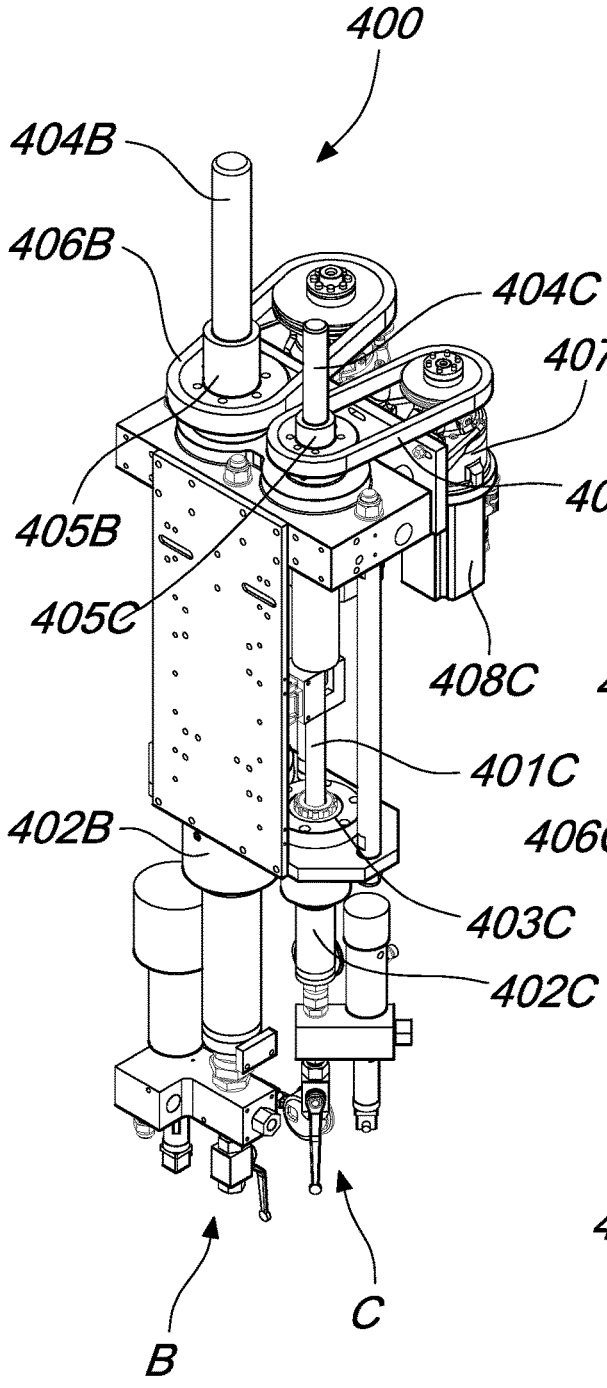
Figure 5B:
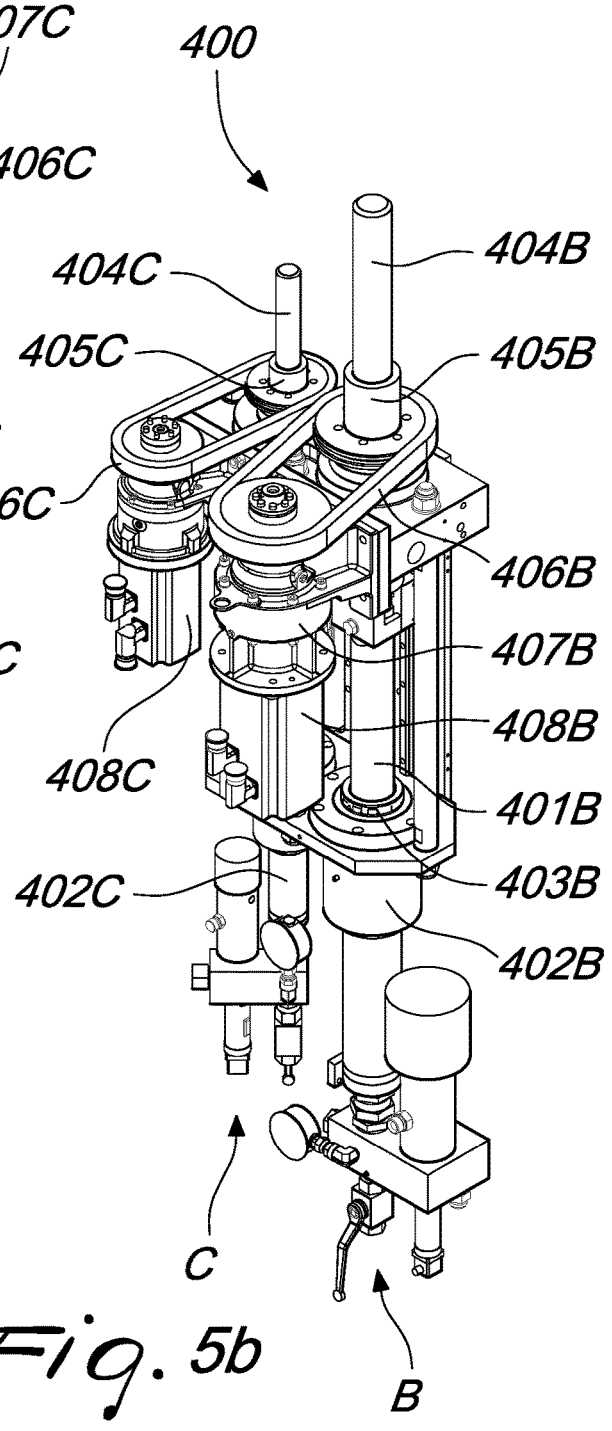

FIGS. 5*a*, 5*b* show the opposite views of the dosage devices of the sealant 7 of the bi-component type; the perspective views are duplicated and arranged mutually opposite for the visibility of all the component elements, all of which belong to the background art.

Figure 6A:
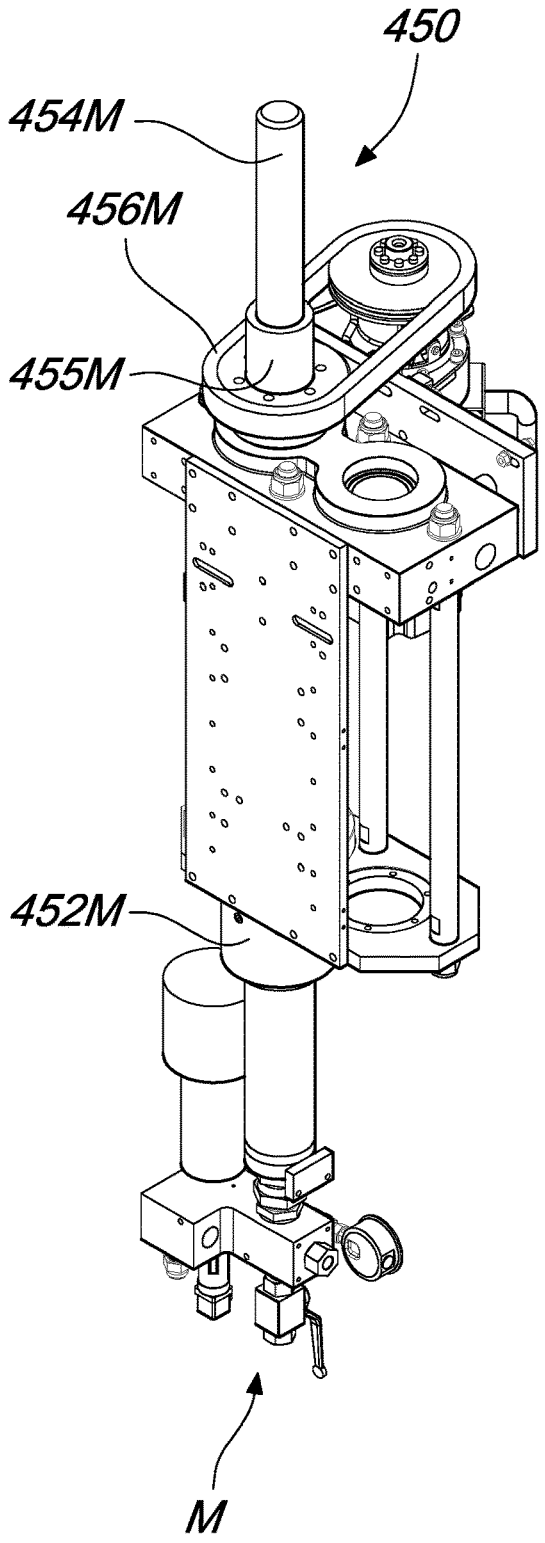
Figure 6B:
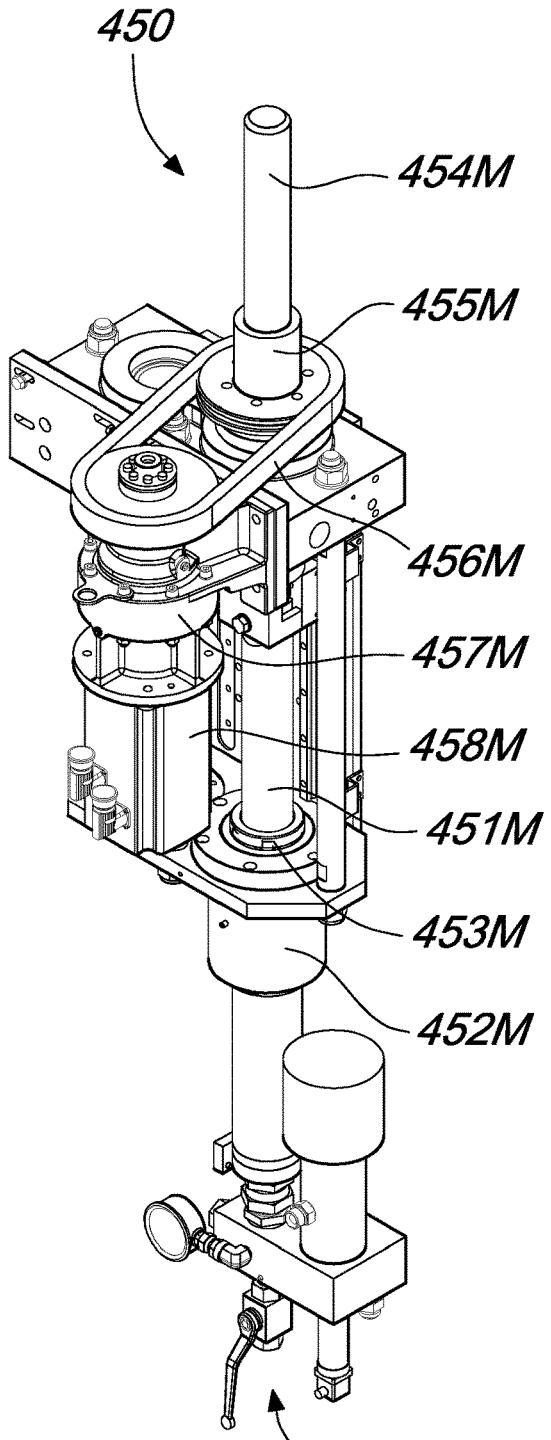

FIGS. 6*a*, 6*b* show the opposite views of the dosage devices of the sealant 7 of the mono-component type; the perspective views are duplicated and arranged mutually opposite for the visibility of all the component elements, all of which belong to the background art.

Figure 7:
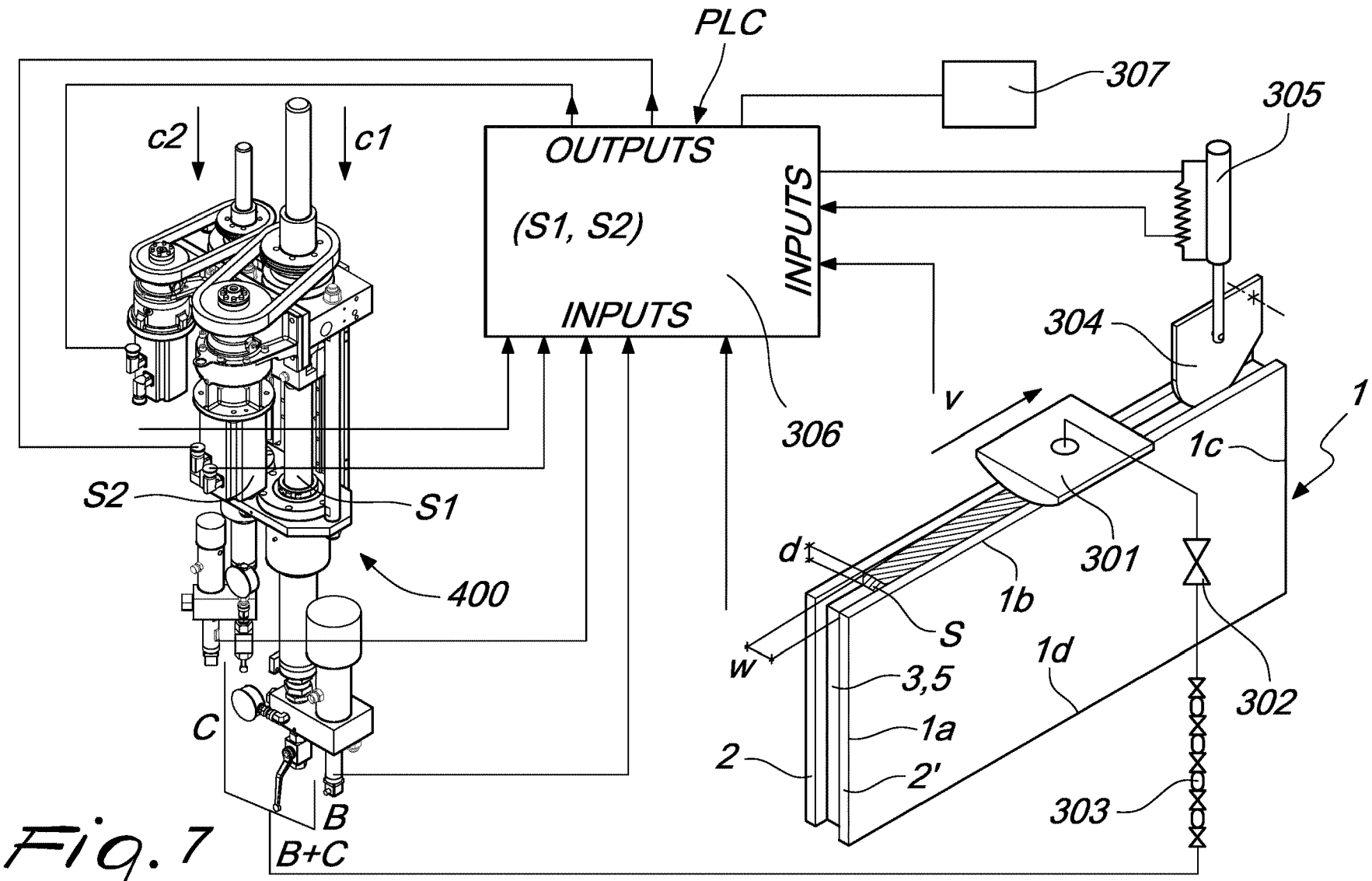

FIG. 7 is a view of the circuits and of the logic and power controllers, again according to the background art which operates on an insulating glazing unit 1 having an ideal (parallelepiped) geometry.

Figure 8:
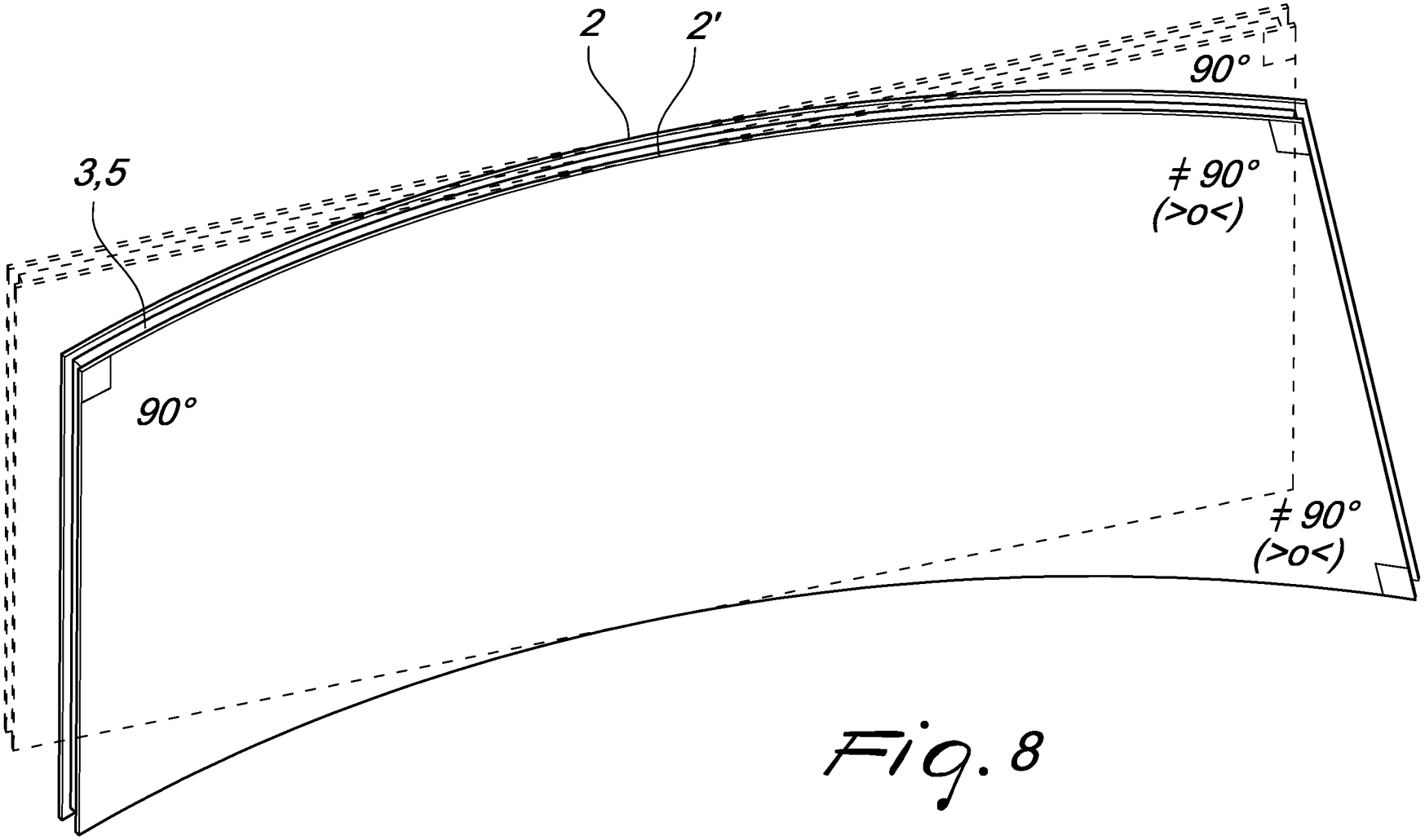

FIG. 8 is a view of the actual geometry of the insulating glazing unit 1 in solid lines and of the ideal one in dashed lines. The aberrations of this geometry are evident, both in the deviation with respect to the theoretical plane (curvature in one direction, the longitudinal one) and in the deviation from the theoretical perimeter (irregularity of the rectangle presented as one side which is not perpendicular to the adjacent ones).

Figure 9:
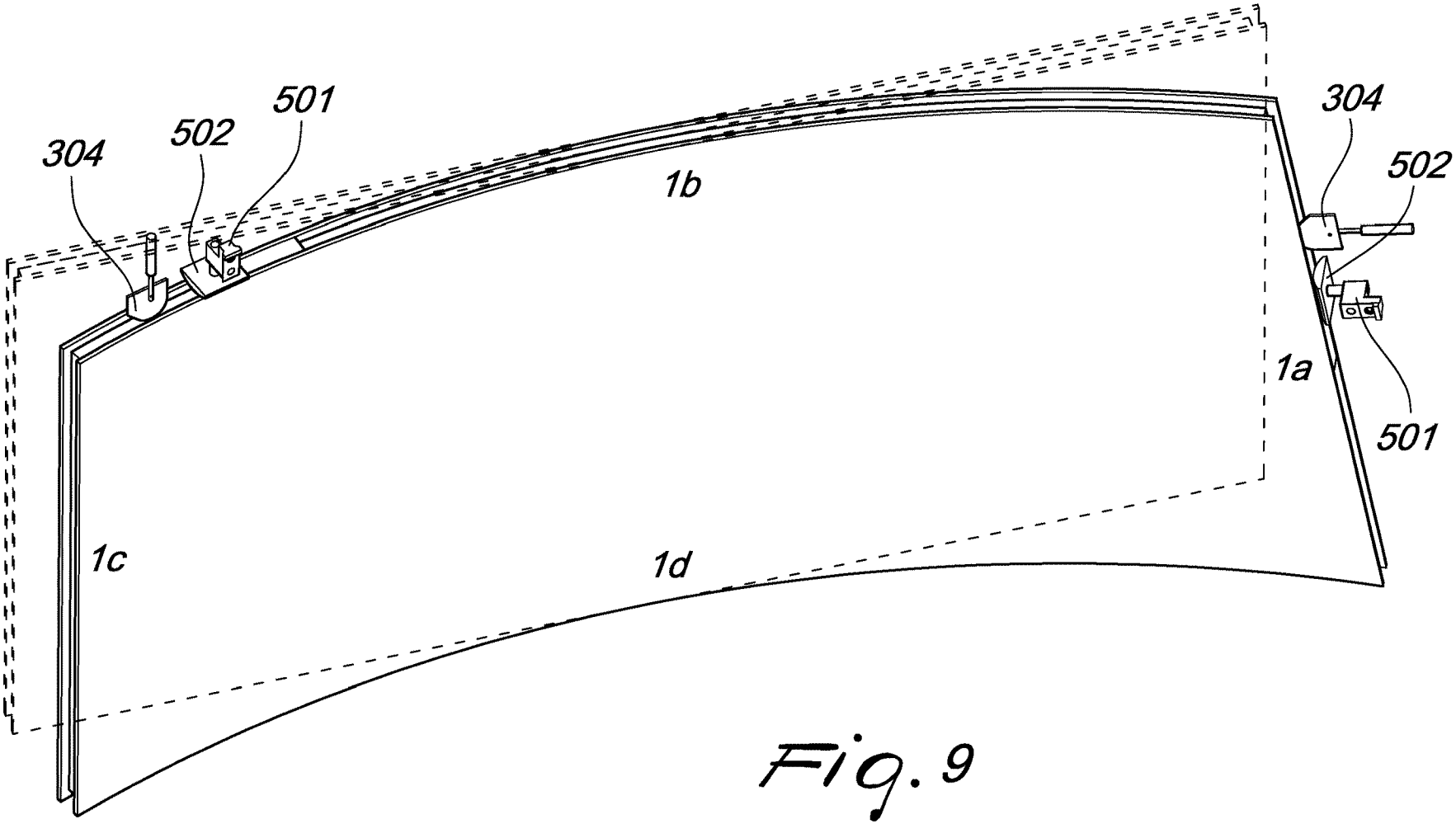

FIG. 9 is a view of the method of adaptation of the sealing devices (nozzle and probe according to FIG. 7, but with the nozzle modified according to the evolutions of the present invention) to the actual geometry of the insulating glazing unit 1, performed according to the invention according to the present patent application.

Figure 10:
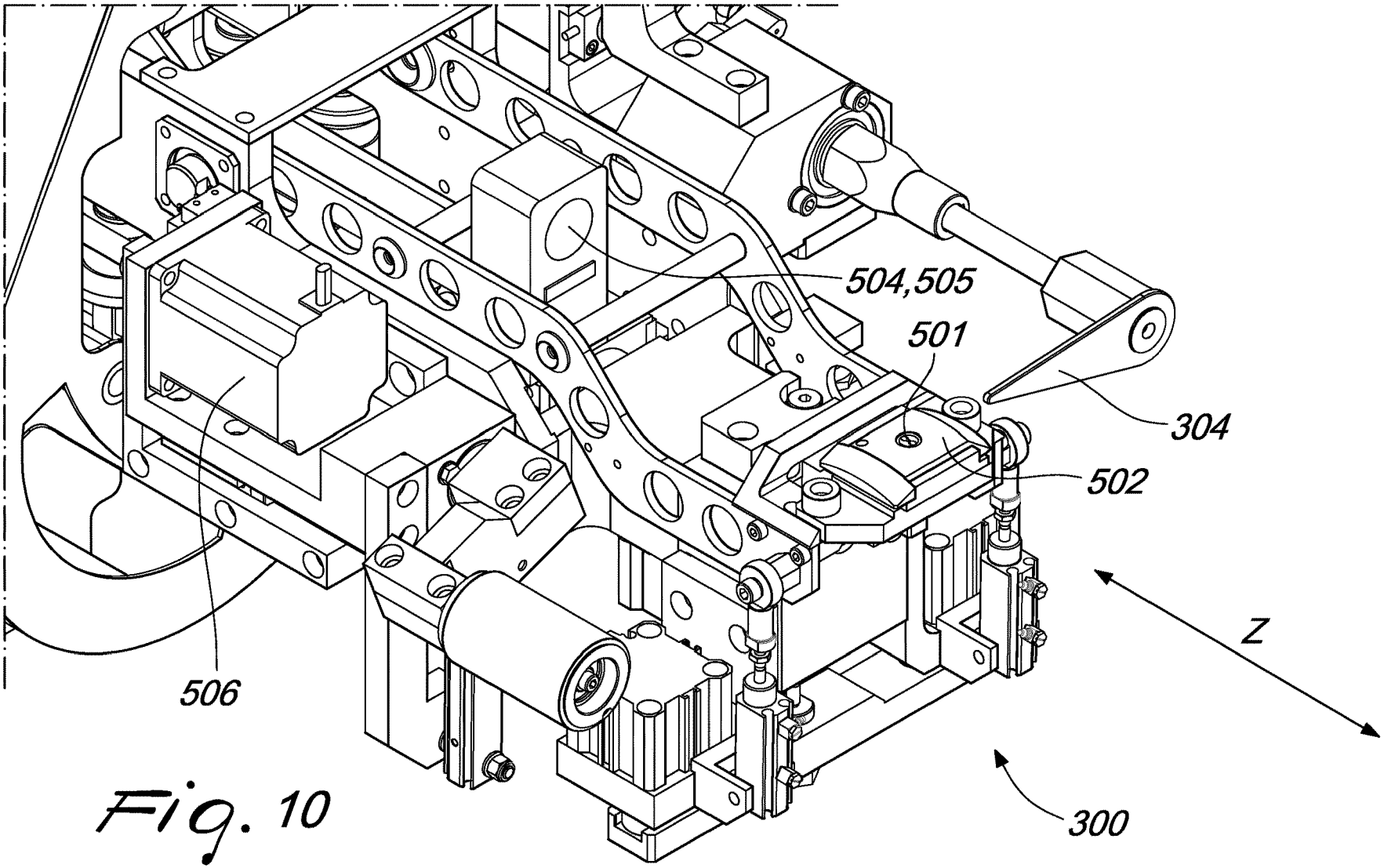

FIG. 10 is a view of the distribution of the sensors in the extrusion head 300.

Figure 11:
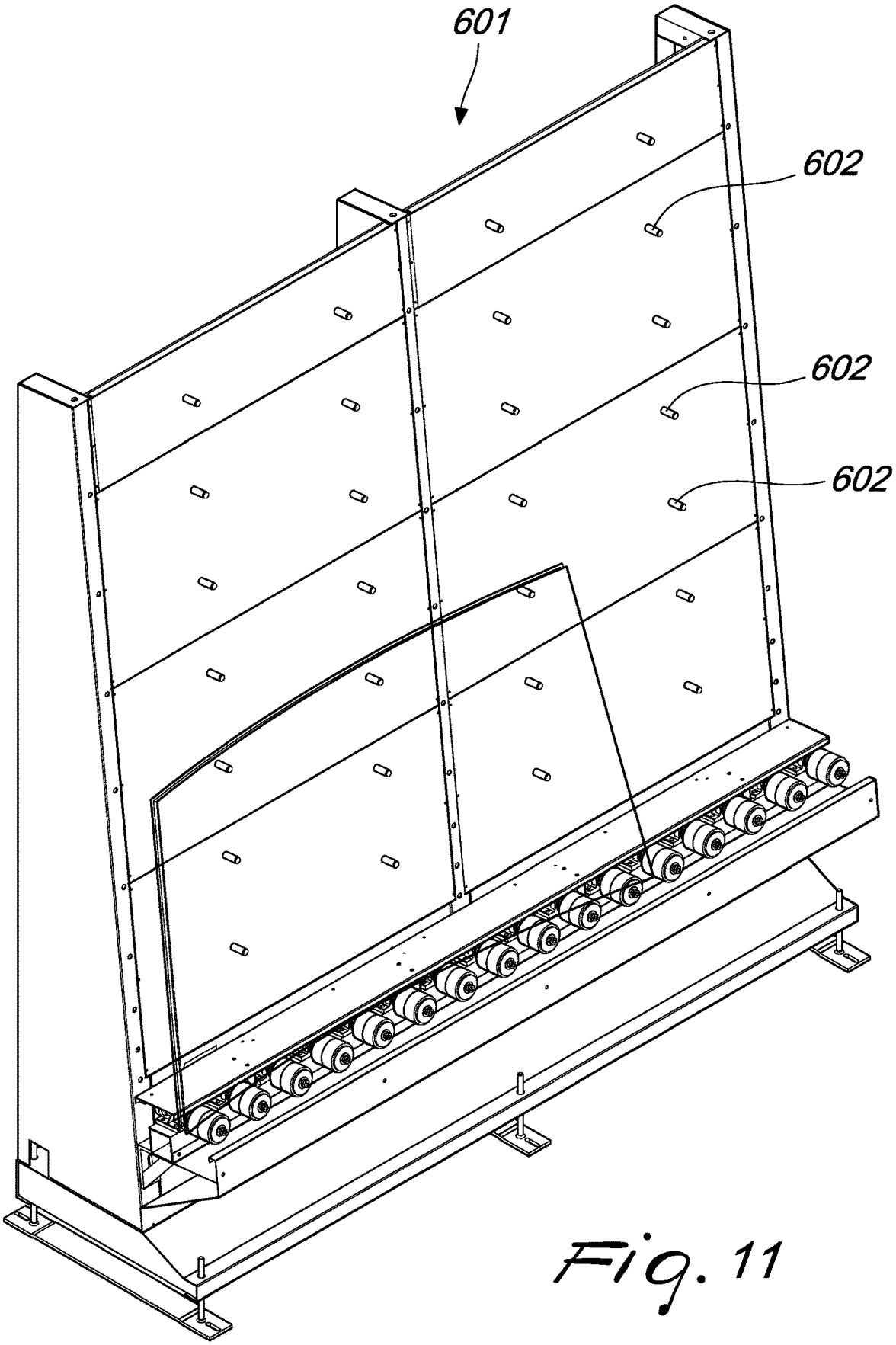

FIG. 11 is a view of the distribution of the sensors in the conveyor 601 upstream of the machine.

Figure 12:
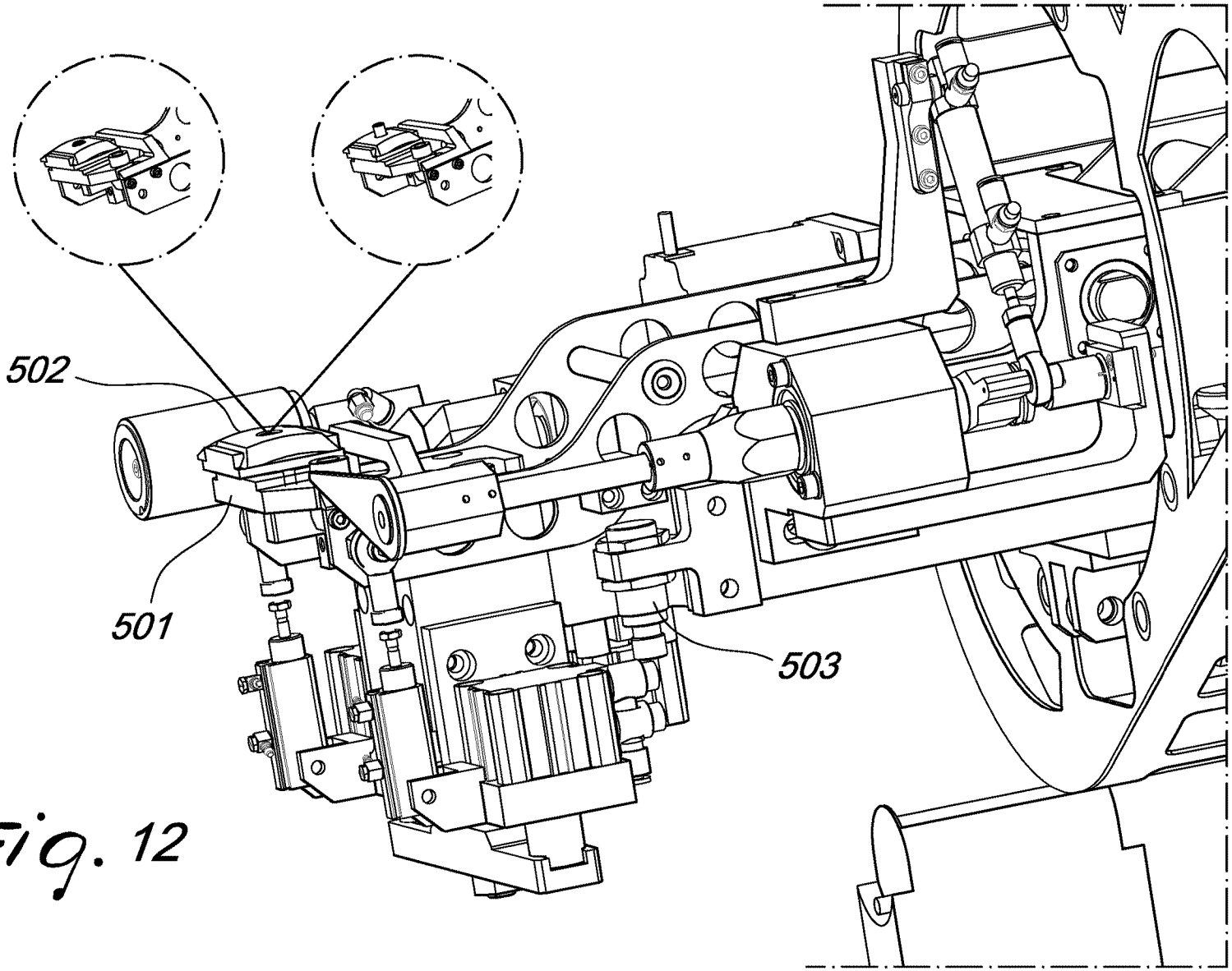

FIG. 12 is a view of the system for following the irregularities of the perimeter of the insulating glazing unit by means of feedback on the axes H, V and θ.

FIGS. 13*a*, 13*b*, 13*c* and 13*d* are respectively views of the insulating glazing unit 1 in its shapes: rectangular 1, polygonal 1', curved 1", mixed 1'. In the case of the rectangular shape, the sides are designated in the sequence of the sealing operation, which occurs therefore according to the following progression: vertical side 1*a*, corner 1*a*/1*b*, horizontal side 1*b*, corner 1*b*/1*c*, vertical side 1*c*, corner 1*c*/1*d*, horizontal side 1*d*, corner 1*d*/1*a*.

Figure 14:
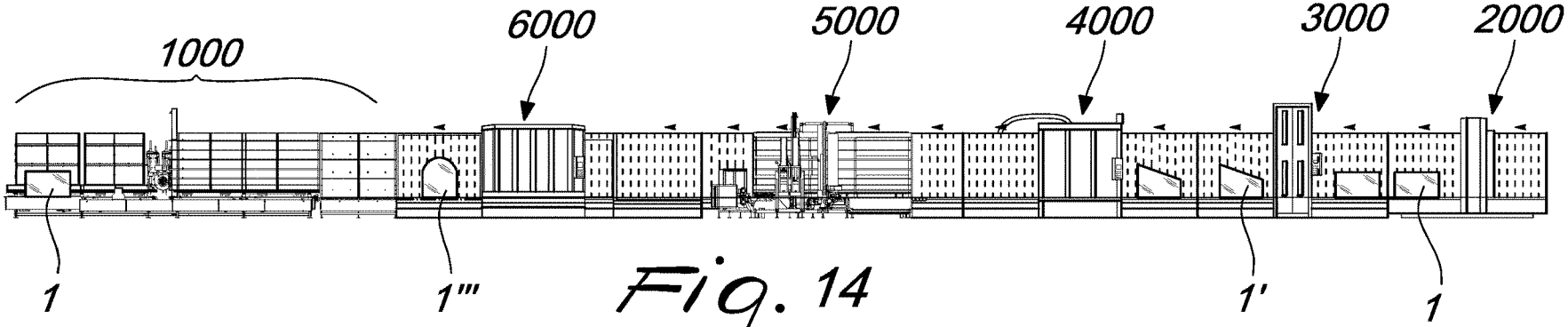

FIG. 14 is an example of insertion of the automatic sealing machine 1000 in the production line of the insulating glazing unit 1 (perspective view) and does not comprise: the electrical/electronic panel, the control post and the protection devices.

Figure 15:
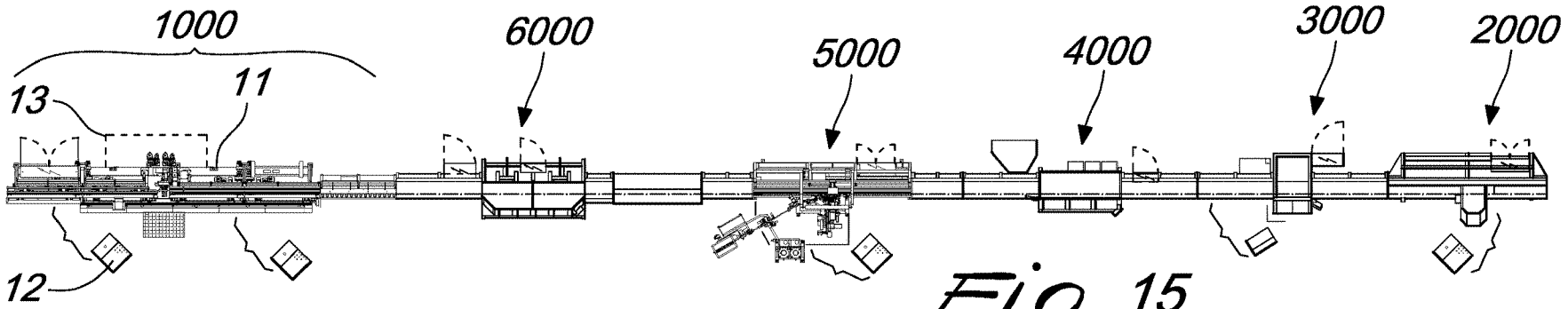

FIG. 15 is an example of insertion of the automatic sealing machine 1000 in the production line of the insulating glazing unit 1 (plan view) and includes: the electrical/electronic panel 11, the control post 12 and the protection devices, designated generated by the reference numeral 13, of the type of mechanical barriers or optical barriers or laser barriers or electrosensitive mats or zone scanners, etc., since particular attention is dedicated not only to the functional, qualitative, and production aspects that are typical of the content of the present invention but also to the aspects related to accident prevention.

The products: insulating glazing unit 1, glass pane 2, 2', 2", 2'", etc., spacer frame 3, 3', 3", etc., 5, 5', 5", etc. and additional components thereof are designated by single-digit numbering optionally provided with indices or letters. In particular, in order to distinguish the various possible shapes of the insulating glazing unit 1, as already anticipated, the numeral 1 designates the most frequent situation (rectangular), the numerals 1' and l'" designate the situations that can in any case be processed with the devices according to the present invention (polygonal and mixed), the numeral 1" designates the shape that is rarely requested and can be processed with integration of devices by the present invention (curvilinear).

The components interfaced with the automatic sealing machine are designated by two-digit numbering.

The main components of the inventive device according to the present application 500, 600 and of the known correlated devices 100, 200, 300, 400, 900 are designated by three-digit numbering, where the ones that contains two zeros refer to assemblies or units, while the others refer to the respective details.

The machines that belong to the production line of the insulating glazing unit 1 are designated by four-digit numerals, in the order according to the description, reserving the numeral 1000 for the automatic sealing machine.

DESCRIPTION OF THE PREFERRED EMBODIMENTS

We now move on to the detailed description of a way of carrying out the invention.

In order to describe a way of embodying the invention, which comprises all the equivalents, reference is made to FIGS. 2, 4, 8 for the general concepts and to FIGS. 9 to 12 for the details suitable to make one or more of the possible embodiments of the invention fully comprehensible to the person skilled in the art.

What is shown partially or not shown in FIGS. 2, 3, 4 regarding the sealing machine per se is instead understood as known, and therefore not requiring a detailed description (since it is part of the background art), since both the prior art documents described earlier and the numerous additional ones, since the sector is very crowded with industrial property titles, and the knowledge of the person skilled in the arts do not require any clarification for the construction of these parts that relate to the automatic sealing machine, which are essentially constituted by the assemblies: 100 for motion along the synchronous horizontal axis H of the glass pane through its lower edge 1*d*; 100' for the motion along the synchronous horizontal axis H of the insulating glazing unit 1 through its front face or sometimes rear face; 200 for the motion of the sealing head along the synchronous vertical axis V; 300 for the extrusion head that rotates about the synchronous polar axis θ; 400 for the dosage units; 900 for the pseudo-vertical conveyors for the support of the insulating glazing unit 1.

A few details related to the background art are instead referenced with regard to the path of the sealant 7, since it is correlated with the function of filling the perimetric joint.

The dosage unit 400 is constituted by the dosage device of the base product B and by the dosage device of the catalyst product C, which, being each in synchronous electrical tie, can deliver the flow of base product and the flow of the catalyst product in the stoichiometric ratio required by the manufacturer of the secondary sealant 7 (typically 10:1 by volume, but any ratio can be adjusted by means of simple inputs in the control panel 12). Of course, in the case of a mono-component sealant the dosage device 450 is a single one, since the catalyst product is not present.

The dosage device of the base product comprises the following essential components: 401B plunger or syringe; 402B cylinder or chamber; 403B seal; 404B ballscrew; 405B ball bearing nut; 406B mechanical transmission, for example of the sprockets/chain type; 407B mechanical reduction unit; 408B synchronous electric motor. Obviously, these components are coupled partly to an upper plate and partly to a lower plate which are connected by tension members, structural elements which are shared and used by the dosage device B of the base product and by the dosage device C of the catalyst product, as can be seen in FIGS. 5*a* and 5*b*.

The dosage device of the base product comprises the following auxiliary components, all of which also belong to the background art: valves, pressure transducers, pressure gauges, protections against overpressures, etc.

The dosage device of the catalyst product comprises the following components: 401C plunger or syringe; 402C cylinder or chamber; 403C seal; 404C ballscrew; 405C ball bearing nut; 406C mechanical transmission, for example of the sprockets/chain type; 407C mechanical reduction unit; 408C synchronous electric motor, coupled as mentioned earlier.

The dosage device of the catalyst product also comprises the auxiliary components as mentioned earlier.

In the case of mono-component sealant 7, the diagram is the same but a single dosage device (series 450 shown in FIGS. 6*a* and 6*b*) is involved.

The operating logic of all these components is shown schematically in FIG. 7, which is intuitive to understand, since on the delivery side the flow-rate of the dosage assembly is equal to c1×S1+c2×S2; where c1 and c2 are respectively the speeds of the syringes of the base products and of the catalyst product, actuated by means of the actuation systems of the motors 408B and 408C, and S1 and S2 are the corresponding cross-sections, and on the destination side the same flow-rate corresponding to the relative speed of the extrusion nozzle 301/side of the insulating glazing unit 1 multiplied by the cross-section S of the perimetric joint, i.e., v×S. Where S is the product of the width w of the spacer profile 3, 5 and the distance d of its outer curved surface from the margins of the glass panes 2, 2' as measured continuously by the probe 304, the position is fedback by means of the potentiometer 305 toward the programmable logic controller (PLC) 306.

FIG. 7 shows other components, such as the flow control valve 302, the mixer 303 for example of the static type, the operator interface (HMI) 307, arranged in the control post 12 for communicating with the PLC.

In detail, as regards the logic and power controls used to perform the dispensing of the sealing product 7 to the nozzle 301, they are managed by the PLC 306, the following are the main INPUTS and OUTPUTS:

Inputs:

#w=width of the spacer frame

#d=distance of its outer curved surface from the margin of the glass panes

#v=relative speed of the peripheral region of the side of the insulating glazing unit 1/extrusion nozzle 301

#signals from the pressure transducers

#feedbacks from the synchronous motors 408B and 408C

Outputs: #signals toward the actuation systems (not shown in the figure) of the synchronous motors, such as to embody the equation v×S=c1×S1+c2×S2.

Other parameters are resident in the PLC, such as for example the cross-sections S1 and S2 of the syringes, since they are constant data.

This description refers to the most complete case of the bi-component sealant. Obviously, it can be applied also to the case of the mono-component sealant simply by eliminating the parts that describe the catalyst fluid.

But it is indeed the FIG. 7 that is misleading, since it represents the insulating glazing unit 1 in a perfect or ideal geometric situation: a parallelepiped. One can imagine how and how much the relationships described above which regulate the process are compromised in the actual situation, which is distorted both in terms of solid flatness and in terms of peripheral planar geometry, which is not dealt with by the background art, shown emphasized in FIG. 8.

And it is in this situation, which in any case is always true, that the inventive concept described hereinafter provides a solution in terms of stability of the process, quality of the seal, safety for the operator. The principle of following the perimetric joint is shown in FIG. 9; how to render executable and especially stable with respect to the background art this following can be deduced from FIGS. 10, 11 and 12 described hereinafter as preferential methods or combination of preferential methods of execution of the invention.

For following the deviation of the geometry of the insulating glazing unit along the axis Z, the sensors, for example of the ultrasound type, 504, or of the optical type 505, or based on another physical value, arranged in the extrusion head 300, as indicated in FIG. 10, are used; their feedback, processed by means of software that incorporates mathematical steps and did not exist at the time of prior art U.S. Pat. No. 7,922,842 B2, acts on the actuator 506, which intervenes by moving the front part of the extrusion head 300 along the direction Z, which is transverse with respect to the plane of the insulating glazing unit 1, in the two directions. This software analyzes the stability condition of the insulating glazing unit 1, since it is arranged in the vertical conveyors 900, which are typically inclined by 5÷8 degrees with respect to the vertical plane and subject to the force of gravity, and stops the corrective action of the actuator 506 to prevent the insulating glazing unit 1, especially if of limited height, by virtue of the action of the nozzle 501 which penetrates toward the perimetric cavity of the joint of the insulating glazing unit since it is cantilevered with respect to the plate 502, and thus also the probe 304 are pushed toward a possible situation of tipping toward the work regions due to an interference against one of the internal faces of the glass panes 2, 2'.

As an alternative, for following the deviation of the geometry of the insulating glazing unit 1 along the axis Z, the array of sensors, for example of the ultrasound type, 602, is used which is arranged in the pseudovertical conveyor 601 upstream of the actual sealing machine, its feedback acting on the actuator 506, which intervenes by moving the front part of the extrusion head 300 along the direction Z, which is transverse with respect to the plane of the insulating glazing unit 1, in the two directions. The array of sensors can be replaced by a scanner, for example of the laser type 603, which is already in use with other functions in insulating glazing unit production lines and is arranged in the pseudovertical conveyor 601: in both of these measurements of the deviations of the geometry of the insulating glazing unit 1 performed in the conveyor 601, the entire surface of the insulating glazing unit 1 is mapped and a data file is built which relates to the deviations of the face of the insulating glazing unit that rests on the conveyor 601 with respect to the plane of the conveyor, the file being transmitted to the sealing machine 1000 in order to move the front part of the extrusion head 300 along the direction Z, which is transverse with respect to the plane of the insulating glazing unit 1, in the two directions by virtue of the intervention of the actuator 506. Of course again under the management of the software according to the preceding paragraph.

Also as an alternative, and positively in order to avoid the situations of instability due to the drift effect described in the description of the background art, both the signals obtained by means of the sensors 503, 504, which belong to the extrusion head 300, and the signals obtained by means of the array of sensors 602 or by means of the scanner 603, which belong to the conveyor 601, can coexist, so as to have a redundant control, which is important so that the nozzle 501 that protrudes toward the perimetric cavity of the joint of the insulating glazing unit since it cantilevers out with respect to the plate 502 and likewise the probe 304 do not push the insulating glazing unit 1 toward a possible situation of tipping toward the work regions due to an interference against one of the internal faces of the glass panes 2, 2'.

For following the deviation of the geometry of the insulating glazing unit 1 in the sense that its perimeter, regardless of the non-flatness since it is managed as above, deviates also from the theoretical geometric shape, the extrusion nozzle assembly is modified with respect to the monolithic one 301 of the background art shown in FIG. 7, the arrangement of which adjacent to the margins of the glass panes 2, 2' is performed by diving with compensation entrusted to elastic systems (springs), splitting it into a plate 502 and into the actual nozzle 501 as shown in FIG. 12. Between these two elements, a transducer 503 sends a feedback signal which interacts with the known actuation systems that control the axes H, V and θ, respectively of the assemblies 100, 100', 200, 300, alone or in a combination of two or in a combination of three, so as to keep constant, according to a set point value that can be entered by the operator by means of the operator interface arranged on the post 12, the protrusion of the nozzle 501 with respect to the plate 502, so that the nozzle performs the extrusion of the sealant 7 in optimum conditions as regards the shape of the perimetric joint to be obtained, in particular of its depth d. If the depth d is significant, it is in fact appropriate to increase this protrusion. FIGS. 10 and 12 show the important function of these components; in particular FIG. 12 shows, in the details shown in circles, the conditions of alignment of the nozzle 501 with the plate 502 and the condition of protrusion of the nozzle 501 with respect to the plate 502.

The control performed by the process PLC toward the actuators of the axes H, V and θ on the feedback signal of the transducer 503 appropriately should be of the PID type (i.e., with parameters P=proportional, I=integral, D=derivative, which can be set independently both for prompt response and to avoid drift situations).

Figure 13A:
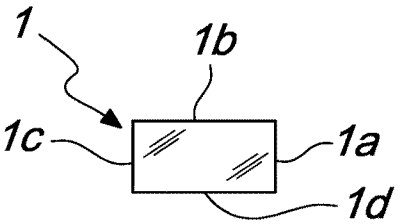
Figure 13B:
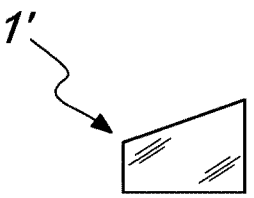
Figure 13C:
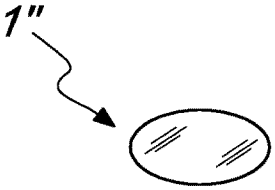
Figure 13D:
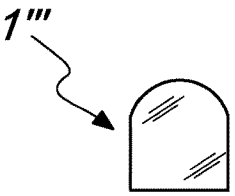

In general and with reference to the most widespread configuration of the insulating glazing unit, i.e., the one having a rectangular shape 1, the succession of the sides being sealed, in the case of a single-head sealing machine 300, is typically the following: first vertical side 1*a*, second horizontal upper side 1*b*, third vertical side 1*c*, fourth horizontal lower side 1D. FIG. 7 shows the situation of a machine according to the background art, with entry of the insulating glazing unit 1 from the left and exit toward the right; FIGS. 9 and 13A show the situation of the machine 1000 according to the present invention, with entry of the insulating glazing unit 1 from the right and exit toward the left.

The inevitable transients of the flow of sealant at the corners where the nozzle 501 must rotate through 90° are already managed, as in the background art, by reduction of the relative speed between the nozzle 501 and the peripheral region of the insulating glazing unit 1 and a corresponding reduction of the flow-rate of sealant until the relative speed is eliminated and the flow-rate is eliminated in order to allow the rotation of the head 300 that supports the nozzle 501 and the closure of the valve 302.

The present invention is susceptible of numerous constructive variations (with respect to what can be deduced from the drawings, the details of which are evident and eloquent), all of which are within the scope of equivalence with the inventive concept; thus, for example, the arrangement of the sensors, the actuation means which can be electric electrical, electrical-electronic, pneumatic, hydraulic and/or combined, etc., the control means, which can be electronic or fluidic and/or combined, etc.

One variation that is already established in the known part of the invention, which however resides practically only in the software and therefore uses the same devices for sealing insulating glazing units having a rectangular shape 1 described so far, is the one constituted by the logical combination of the synchronous actuations, respectively: of horizontal translation along the axis H of the insulating glazing unit 1 by means of synchronous motors; of vertical translation along the axis V of the head 200 by means of a synchronous motor; of rotation according to the axis θ of the head 300 by means of a synchronous motor; of actuation of the flow control element 302 of the nozzle 501; so as to allow sealing on the insulating glazing unit 1' having a shape other than rectangular since it is a regular or irregularly polygonal or on an insulating glazing unit 1" which has a shape other than rectangular since it is curvilinear or on an insulating glazing unit 1'" which has a shape other than rectangular since it contains both rectilinear and curvilinear parts. For these shapes also, the sensors, which belong to the inventive part of the invention 503, 504, 505, 602, 603, shown in FIGS. 10, 11 and 12, all operate as already described and shown for the case of the insulating glazing unit 1 having a rectangular shape.

The constructive details can be replaced with other technically equivalent ones. The materials and the dimensions may be any according to the requirements in particular arising from the dimensions (base and height) and/or from the shape of the glass panes 2, 2', 2", 2", etc. that constitute the insulating glazing unit 1.

The description given above and the corresponding figures refer to an automatic sealing machine 1000, which includes the innovative devices of the series 500, 600 for uniform, functional and precision filling of the peripheral joint of the insulating glazing unit 1 by means of a secondary sealant 7 with respect to which sealing machine the original machines (mating unit and press, optionally with gas filling, etc.) are arranged to the right; it is easy to imagine a description and corresponding figures in the case of mirror-symmetrical or otherwise different arrangements, for example including a variation of the work direction of the line.

INDUSTRIAL APPLICATION

The industrial application is of assured success, since machines for the automatic execution of the second seal of the insulating glazing unit 1 have developed particularly in the last decade, so much that the proprietor of the present application has already marketed over four hundred of them, but these automatic sealing machines have the limitations described earlier.

Currently, the types of insulating glazing units have undergone a surprising increase; it is sufficient to think of structural glazing, which extends over heights of more than one storey of the building, or of commercial glazing, which reaches lengths of over 12 meters, and of the consequence that the large extensions of the surface entail the use of thicknesses of the glass panes which are also important and the use of configurations of glass panes that range from tempered to laminated and accordingly their deviation from planar geometry, which is already per se present due to the large dimensions, is therefore even worsened. Moreover, the range of automatic sealing machines according to the background art has turned out not to be suitable for this parallel development of the final products, or only partially able to solve the problem.

The insertion of the present invention in the production line of the insulating glazing unit is shown in FIGS. 14 and 15 (perspective view and plan view), as an evident confirmation of the assured success in industrial application, in view of the by now established but always evolving diffusion of these lines.

Moreover, the machine according to the present invention can be easily implemented in existing lines, since as it performs the last treatment of the process for the manufacture of the insulating glazing unit it is a matter of replacing the obsolete machine with this innovative machine without altering the placement of all the upstream machines, since one intervenes only on the terminal part of the line.

Not least, the fact of including devices and logic systems dedicated to the control of the static stability of the insulating glazing unit during the sealing process, in addition to implementing further configurations which fall within the concept of machinery of the "Industry 4.0" type, provides elements dedicated to safety which are complementary to the ones designated by the reference numeral 13 in the description.

The disclosures in Italian Patent Application No. 102017000101114 from which this application claims priority are incorporated herein by reference.

Where technical features mentioned in any claim are followed by reference signs, those reference signs have been included for the sole purpose of increasing the intelligibility of the claims and accordingly, such reference signs do not have any limiting effect on the interpretation of each element identified by way of example by such reference signs.

The invention claimed is:

1. A machine for the automatic sealing of a perimetric cavity of an insulating glazing unit, a geometry of which insulating glazing unit is irregular in terms of flatness and shape with respect to a theoretical geometry, the insulating glazing unit constituted by at least two glass panes and at least one spacer frame located proximate to a perimeter at a finite distance from a margin of said glass panes or of a smaller glass pane, the glass panes being optionally aligned or offset along one or more perimetric sides and a thickness both of each glass pane and of each spacer frame and therefore a total thickness of the insulating glazing unit being optionally variable from one insulating glazing unit to another, the machine constituted by a control system controlling: at least one synchronous conveyor that supports and displaces the insulating glazing unit along a horizontal axis H during a sealing cycle; at least one synchronous carriage which runs on vertical guides along a vertical axis V provided with a sealing head, the sealing head having a synchronous rotary motion around axis θ so that a sealing nozzle is oriented so as to be tangent to a perimeter of the insulating glazing unit, and wherein a relative movement between the insulating glazing unit and the sealing nozzle is controlled by the control system, the control system receiving feedback from a sensor that detects an amount of protrusion of the sealing nozzle from a plate, wherein the perimetric cavity is fed by one or more synchronous volumetric units for a dosage of bi-component or mono-component sealant; each synchronous dosage unit dispensing sealant based on dimensions of the perimetric cavity comprised between the glass panes and an outside curve of the spacer frame and of a relative speed between the nozzle and the perimeter of the insulating glazing unit, so as to fill the cavity up to an extreme margin of a smaller glass pane or of the glass panes if aligned, characterized in that devices interfaced and operating in connection with the perimetric cavity of the insulating glazing unit during sealing follow without discontinuities an actual position of said cavity along the axes H, V and θ, which is different from the theoretical position due to a geometric irregularity of the perimeter of the insulating glazing unit.

2. The automatic machine according to claim 1, wherein a position of the devices along the axes H, V and θ is corrected to follow displacements between the actual position and the theoretical position, by an extrusion nozzle device comprised of a plate, which is pushed against edges of the glass panes, and of an extrusion nozzle, which has such a shape as to pass freely through the plate, between the plate and the extrusion nozzle is a transducer providing feedback about a mutual distance, which a control system adjusts so as to keep the mutual distance constant by acting on actuation systems of the axes H, V and θ.

3. The automatic machine according to claim 2, wherein the control system comprises proportional, integral, and derivative parameters, each of which parameters can be set independently.

4. The automatic machine according to claim 2, wherein a body of a potentiometer, a stem of which carries a probe, is integral with a structure that carries the plate.

5. A machine for automatic sealing of a perimetric cavity of an insulating glazing unit:

wherein the insulating glazing unit comprises:

at least two glass panes, wherein the glass panes are the same or different sizes, and at least one spacer frame, wherein the spacer frame is located proximate to the perimeter of the insulating glazing unit at a finite distance from a margin of the glass panes or a smaller of the glass panes, wherein the glass panes are aligned or offset along one or more perimetric sides, wherein a cavity is between the glass panes and an outside curve of the spacer frame, and wherein the perimetric cavity of the insulating glazing unit has a theoretical position and an actual position;

wherein the machine comprises:

at least one synchronous conveyor coupled to a synchronous suction cup carriage configured to support and displace an insulating glazing unit along a horizontal axis H during a sealing cycle;

at least one synchronous carriage which runs along vertical guides along a vertical axis V wherein the synchronous carriage is provided with a sealing head, said sealing head having a synchronous rotary motion θ so that a sealing nozzle is oriented on a tangent to a perimeter of the insulating glazing unit;

an actuator for continuous adjustment of the sealing head along a transverse axis Z;

at least one dosage assembly controlled by a synchronous electric motor, wherein the dosage assembly is selected from a mono-component sealant dosage assembly and a bi-component sealant dosage assembly, wherein the at least one dosage assembly feeds sealant to the sealing head; and a programmable logic controller controlling the at least one synchronous conveyor, the at least one synchronous carriage, and the actuator, wherein a flow rate of the dosage assembly is adjusted as a function of dimensions of the perimetric cavity and a relative speed between the sealing nozzle and the perimeter of the insulating glazing unit such that the perimetric cavity is continuously filled with adjustment along the transverse axis Z, wherein the cavity is filled up to the margin of the glass panes when the glass panes are aligned or to the margin of the smaller glass pane when the glass panes are of different sizes, wherein the programmable logic controller receives feedback to adjust the at least one synchronous conveyor, the at least one synchronous carriage, and the actuator such that the cavity is continuously filled when: the theoretical position and the actual position of the perimeter do not match, because the perimeter of the insulating glazing unit is irregularly shaped, because the insulating glazing unit has irregularity in flatness, and combinations thereof.

6. A method for the automatic sealing of perimetric cavity of an insulating glazing unit, a geometry of which is irregular in flatness and shape, performed in the machine according to claim 5, wherein devices interfaced and operating in connection with the perimetric cavity of the insulating glazing unit during sealing follow without discontinuities the actual position of said cavity along axes H, V and θ.

7. A method for automatic sealing of a perimetric cavity of an insulating glazing unit, a geometry of which has irregularities in flatness and shape, performed in the machine according to claim 5, wherein devices interfaced and operating in connection with the perimetric cavity of the insulating glazing unit during sealing follow without discontinuities an actual position of said perimetric cavity along a transverse axis Z.

8. The automatic machine according to claim 7, wherein sensors for correction along the axis Z are located on an extrusion head and related feedback towards the actuator for the continuous adjustment of the devices along the axis Z is controlled by software which, as a function of the geometry of the insulating glazing unit, stops the corrective adjustment if the corrective adjustment reaches conditions of static instability of the insulating glazing unit placed in the synchronous conveyors.

9. The automatic machine according to claim 7, wherein an array of sensors for correction along the axis Z is located on a synchronous conveyor upstream of an extrusion head and wherein the array of sensors maps in a single step or by incremental regions, an entire surface of the insulating glazing unit in order to provide an actuator for continuous adjustment of the devices along the transverse axis Z with global information related to the entire surface and the perimeter of the insulating glazing unit.

10. The automatic machine according to claim 7, wherein sensors located on an extrusion head for continuous correction along the axis Z and an array of sensors located on the synchronous conveyor for continuous correction along the axis Z cooperate so that the actuator for continuous adjustment of the devices along the axis Z stabilizes the insulating glazing unit.

11. The machine according to claim 7, wherein the bi-component sealant dosage assembly comprises a dosage unit for a base product and a dosage unit for a catalyst product, wherein a stoichiometric dosage ratio of base product to catalyst product is adjustable.

* * * * *